United States Patent [19]

Landeroin-Duvernois

[11] 4,091,263

[45] May 23, 1978

[54] PROCESS AND A DEVICE FOR CONTROLLING THE RADIATION-CONVECTION RATIO IN A HEATING APPARATUS

[76] Inventor: Odette Landeroin-Duvernois, "L'Archerie", Cellettes, 41120 Les Montils, France

[21] Appl. No.: 674,054

[22] Filed: Apr. 5, 1976

[30] Foreign Application Priority Data

Apr. 14, 1975 France ..... 75 11512

[51] Int. Cl.[2] ..... F24H 3/00

[52] U.S. Cl. ..... 219/377; 165/55; 219/342; 219/367; 219/368

[58] Field of Search ..... 219/365, 374, 377, 342, 219/343, 347, 367, 368, 366, 375; 165/55, 56, 57

[56] References Cited

U.S. PATENT DOCUMENTS

| | | | |
|---|---|---|---|
| 1,064,258 | 6/1913 | Sharpe | 219/377 |
| 1,155,593 | 10/1915 | Mansbridge | 219/377 X |
| 1,867,740 | 7/1932 | Guy | 219/368 X |
| 2,329,592 | 9/1943 | Clemens | 219/375 X |
| 3,436,524 | 4/1969 | Pauls | 219/347 |
| 3,596,058 | 7/1971 | Steiner | 219/367 |

FOREIGN PATENT DOCUMENTS

| | | | |
|---|---|---|---|
| 1,008,890 | 5/1957 | Germany | 219/377 |
| 619,648 | 10/1935 | Germany | 219/377 |

*Primary Examiner*—Thomas J. Kozma
*Attorney, Agent, or Firm*—Young & Thompson

[57] ABSTRACT

In a heating apparatus comprising heating elements such as elongated tubular heating elements, radiating heat towards the heated space, and a reflector located behind said heating elements, the radiation-convection ratio is controlled by slowing or braking the upwardly directly current of convection air heated in contact with the heating elements. A box-like member is provided above the heating elements in order to retain the convection air flowing upwardly, thus braking said upward movement of the air. A cushion of hot air is thus created within said box-like member, which opposes the upward movement of additional heated air. The box-like member is open rearwardly to permit escapement of air, thus reducing both the velocity and the temperature of the convection air leaving the apparatus. This results in a much more uniform temperature in the space, for instance in a room, heated by the apparatus, the temperature near the floor and near the ceiling being substantially equal.

6 Claims, 2 Drawing Figures

PROCESS AND A DEVICE FOR CONTROLLING THE RADIATION-CONVECTION RATIO IN A HEATING APPARATUS

This invention relates, generally, to radiation and convection heating devices, in particular, but not exclusively, to devices or apparatus for space heating.

It is already known practice to heat a space by means of devices giving out heat simultaneously by radiation, either direct or after reflection, and by convection of the ambient air. This convection movement is obtained in particular by the circulation of the air heated in contact with the heat source.

A heating device of this type is described in detail in French patent No. 2,046,668. According to this patent, the heat source consists of one or more long heating elements (each consisting of an electrical resistance) placed opposite a reflector behind which is located at a certain distance at least one deflector. The space is therefore heated on the one hand with the aid of a reflector, which sends out the heat radiated by the heating element placed in front of it and opposite its opening, and on the other hand with the aid of a double convection current arising from the passage provided between the rear face of the reflector and the deflector and at the level of the heating element, by heating of the air in contact with them.

The air heated in this way tends to rise and escapes towards the top of the heating device. The maintenance of the temperature of a space depends therefore on the combination of these phenomena appertaining to a given heating apparatus. It will easily be understood that the phenomenon of radiation contributes essentially to the heating of the lower layers of air in a space when the device is situated near the ground, whilst the phenomenon of convection contributes rather to the heating of the upper layers of air in a space. p Up to the present time, the various radiation-convection heating devices do not limit the convection flow, so that, on the one hand, the warm convection air is brought to the exit of the heating device at a high temperature, often exceeding permissible norms and, on the other hand, the temperature of the air at ceiling level is much greater than that of the air at ground level. Now the ideal is of course to have a distribution of temperature in any part of the space as uniform as possible.

An object of the invention is to remedy these disadvantages. Primarily, the intention is to provide a device which achieves a uniform temperature distribution in the heated space.

Another object of the invention is to create a device allowing a smaller value to be given to the temperature of the convection current at the exit point of the apparatus, so that it is more in conformity with permissible norms.

A further object is to increase the output of the heating apparatus.

These results are attained by controlling the convection current arising in contact with the heating elements. The process for controlling radiation-convection heating according to the invention is characterised by the fact that the convection current is intercepted and slowed down after contact with the heating element or with the last heating element of a group of elements in a heating apparatus, thus forming a cushion of hot air, which by reaction, has a braking influence on the convection movement of the air at the level of the heating element or elements.

The braking of the convection current reduces the speed of the air in contact with the heating element or elements and thus reduces the cooling effect on these elements, so that the latter may work at a higher stabilisation temperature corresponding to optimal working conditions.

A further result of the slowing down of the convection is an increase of the radiation-convection ratio, that is a proportionally more intense heating by radiation of the lower parts of a space, for example, and consequently a higher degree of comfort for the persons therein.

Another object of the invention is to provide a heating apparatus comprising a casing within which is located at least one heating element giving rise to radiation heat and convection heat, characterised by the fact that, downstream of this heating element or elements in the path followed by the convection current, there is provided a part in the form of a box acting as interceptor and convection brake.

This box is suitably placed above the heating element or elements of the apparatus.

According to one embodiment of the invention, the box consists of a front partition which is closed and forms a chamber, and a rear shorter partition linking with an exit passage for the convection air. Thus, the flow of convection air heated in contact with the heating element or elements is collected in the upper closed section of the box, where it undergoes a complex turbulence creating a cushion of hot air which itself acts as convection brake on the flow of air arriving. This hot air then escapes by the previously mentioned passage.

According to an advantageous feature, in the case of a heating apparatus in which a reflector combined with the heating elements is associated with a rear deflector forming a chimney for the passage of convection air cooling the rear face of the reflector, the above mentioned exit passage connects with this chimney. The result is a drawing out of the hot air retained in the heating box thus created.

According to another feature, the front edge of the box is bent to form a hood trapping the ascending air flow heated in contact with the heating elements to direct it into the box. When several heating elements are placed one above the other in a device of the type under consideration, the arrangement obtained by the combination of these heating elements and the front part of the box, with its hood, provides a chimney effect which prevents stagnation of the air at the level of the heating elements so that they do not overheat, and helps to attain the required balance between the radiation and the convection heat. In the unit thus constructed, the upper heating element serves as initiator in the chimney effect obtained.

It should be noted that the front partition of the box heated in this way returns heat to the space also by radiation. If wished, this box may be wholly or partially lined with refractory material, in order to accumulate heat, which is then progressively returned to the space to be heated.

As a result of the braking of the convection, the arrangement which is the subject of the invention allows the attainment of improved regulation of what is called the dynamic air temperature of the apparatus, that is in fact of the temperature of the air ensuring the convection heating. In fact, in known apparatus, the direct emission into the space of the air heated in contact with the heating elements, of necessity provides air at a high temperature. In the case of the invention, on the contrary, this air, as a result of being momentarily retained in the "heat box" thus constructed, has time to release a part of its potential heat to the partitions of this box, and from them this heat is emitted to the outside by radiation; thus it leaves the apparatus at a lower and better controlled dynamic air temperature.

Although the invention is particularly applicable to devices using tubular electrical resistance heating elements, it is understood that it is not limited to the use of this type of element, and that the device which is the subject of this invention may be fitted with heating elements of various kinds.

Figure 2:
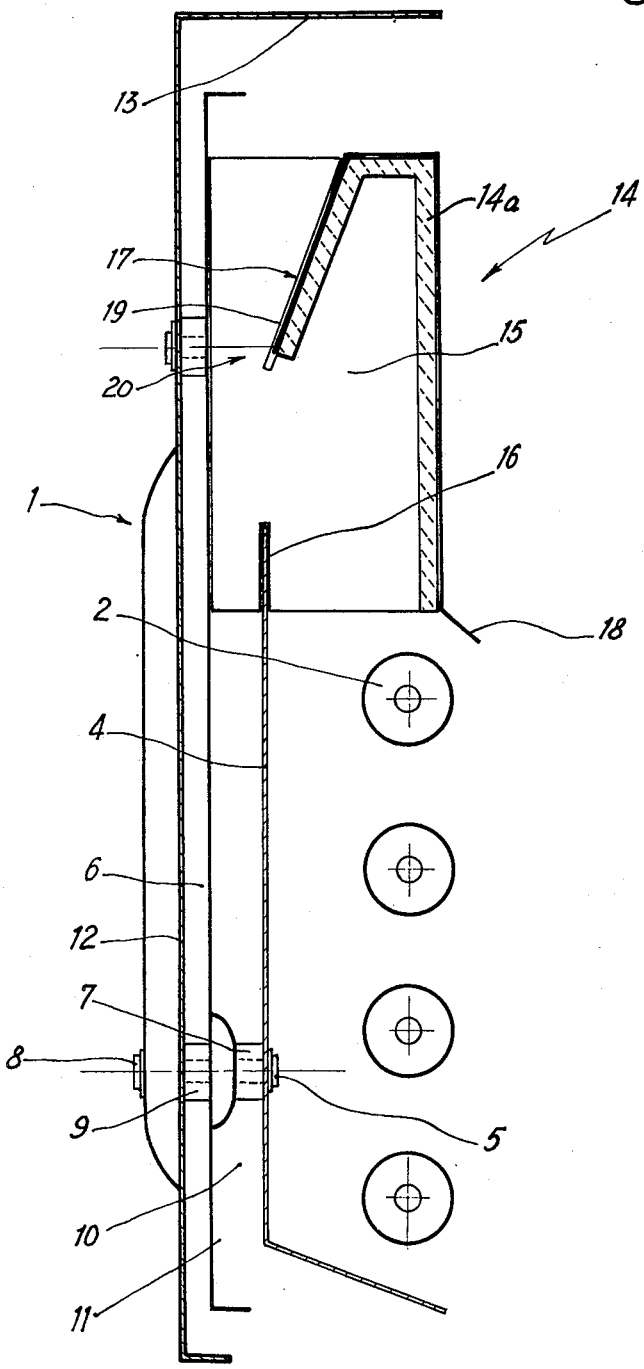
FIG. 2 is a vertical cross section of the apparatus.

The heating device according to the invention comprises a body 1 enclosing the heating elements 2 held in position by appropriate brackets of insulating material. A reflector 4 is located behind the heating elements 2. This reflector is in the shape of a dish open towards the front, that is towards the heating elements 2, and partially surrounding these tubes at the back, in order to return by radiation the heat released by the heating elements 2 to the heated space. As indicated in FIG. 2, this reflector is fixed by rivets 5 onto the vertical wall of a deflector 6, with spacing rings 7 receiving the rivets, this deflector being itself fixed to the rear face of the body 1 by rivets 8, with spacing rings 9.

Figure 1:
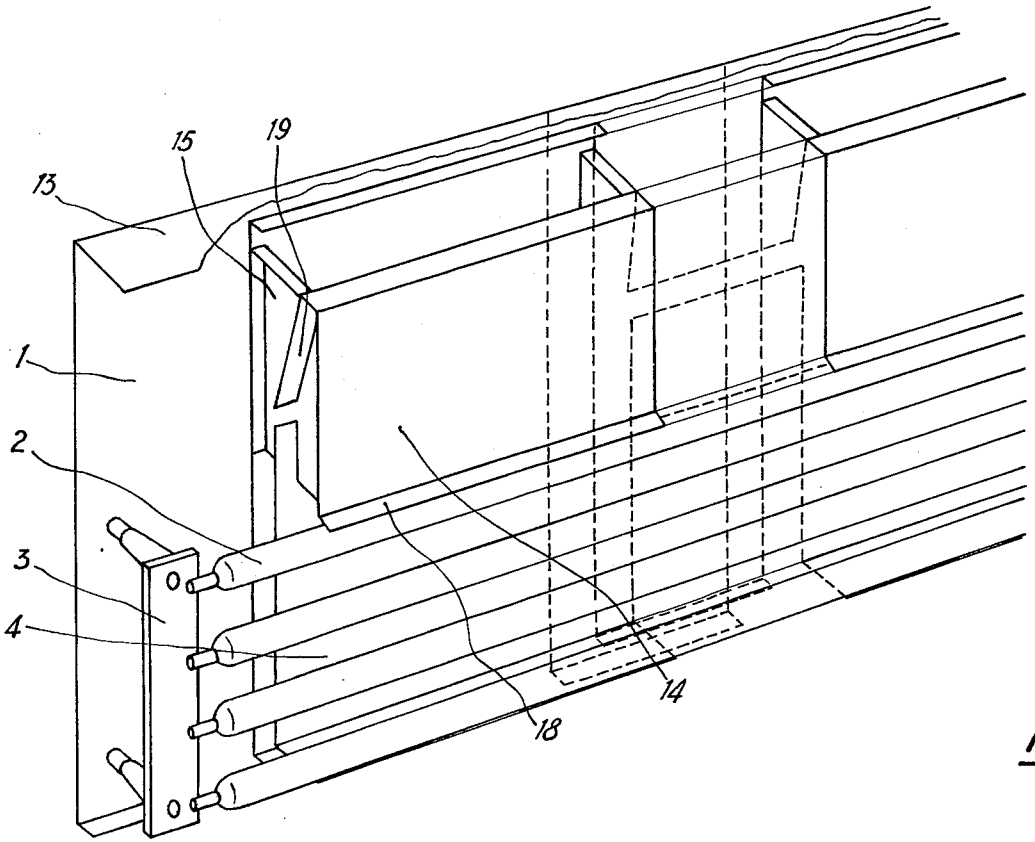
FIG. 1 is a perspective view of a particular form of heating device in accordance with the invention.

The vertical wall of the deflector 6, together with the vertical wall of the reflector 4, forms a space 10 providing a chimney 11 for the passage of convection air. In the base of the body 1 are provided orifices for the admittance of air communicating with the said chimney 11. In use, an ascending air circulation is produced through this chimney, said air contacting the rear face of the reflector 4. This contact heats the air which takes up the heat accumulated on the rear face of the reflector, and contributes to the heating of the space by convection. In the same way, the deflector 6, together with the vertical wall 12 of the body 1, forms a chimney through which an ascending circulation of air contacts the rear face of the deflector 6. This contact heats the air which then drains the heat which is able to accumulate on the deflector. The rear wall 12 of the body 1 is bent in its upper section as shown at 13 in FIGS. 1 and 2, in order to force the air to circulate across the baffle thus obtained and to reduce the speed of flow whilst still directing it towards the front of the apparatus.

In this way, the heat released by the heating elements 2 is drained in entirety in order to heat the space, the rear wall of the apparatus being noticeably cold.

According to the invention, a box 14 is mounted above the heating elements 2 in such a way as to cap the last element. (In FIG. 1, four heating elements are mounted one above the other on the same brackets.). This box is supported by its two lateral sides 15 on the upper part of the deflector 6 and these lateral sides are fixed onto the deflector by known methods. Moreover, the sides 15 have vertical slots 16 in their lower part to receive the upper edge of the reflector 4. In the upper part of these sides 15 is provided a slot 17 inclined towards the bottom and towards the deflector, and its end is located at a distance from the deflector which is virtually equal to the width of the first chimney 11. These slots are intended to receive and hold the box 14, which is bent in the form of a profiled shape from thin sheet metal. The lower part 18 of this section is bent forward in such a way as to form a hood completely covering the upper heating element. The upper part 19 of the section has been bent inwards in order to fit into the upper slots of the lateral partitions, the front face of the box thus formed being then parallel to the reflector and to the deflector.

In the assembly thus constructed, the heating elements radiate their heat, and heat the lower part of the space. But the air which is in contact with the heating elements is going to heat up and will undergo a vertical ascending acceleration, which will be magnified by the heating effect of each following element, so that on the level of the top element there exists an actual convection flow. According to the invention, this flow is channelled by the upper part of the reflector 4 and by the hood 18 of the box 14 and is collected in the latter. The hot air is then trapped between the lateral partitions 15, the front vertical part of the box 14 and the upper inclined edge 19. Thus a mass of hot air is established in the box 14 which acts as a "cushion" of hot air braking the afore-mentioned current or flow of convection, since this flow can no longer freely escape upwards. As a result of this braking effect, a reduced colder air flow is obtained in contact with the heating elements, so that the latter may function at a higher stabilization temperature, corresponding to optimal working conditions. It will be easily understood that from this, there is a resulting improvement in radiation relative to convection, and in consequence an improved heating of the lower parts of the room, with increased comfort for the persons therein.

In addition, this interception of hot air causes a heating of the walls of the box 14, which will then likewise radiate heat from its front external partition. If wished, this box may be furthermore lined partially or completely with a refractory material **14*a***, so that it then acts as heat accumulator.

After being intercepted by the box 14, the hot air in contact with the heating elements will escape via the passage 20 formed between the upper bent section 19 of the box 14 and the deflector 6. This escape is favoured by the chimney effect created in this region and by the drawing action of the ascending convection air current created between the reflector 4 and the deflector 6 as previously indicated. Thus the hot air collected in the box 14 having undergone a complex turbulence in the chamber thus created is drawn out of the apparatus to ensure the heating of the space by convection.

Modifications may be made to the embodiment described, within technical equivalencies, without departing from the invention. Thus the shape and dimensions of the box may vary, just as other support elements can be provided identical to the lateral sides 15, acting in such a way as to create several boxes side by side, with the same section. Likewise the means for positioning the reflector and the deflector can be changed, and for example screws may be used with nuts acting as spacers.

What is claimed is:

1. In a space heating apparatus comprising at least one heating element, reflector means arranged behind said at least one heating element, so as to radiate heat towards the space to be heated, both directly from said at least one heating element and indirectly from said reflector means, and means for directing towards said space to be heated, hot convection air which has been heated by said at least one heating element; the improvement comprising a box-like member arranged above said at least one heating element, a casing enclosing at least said one heating element and extending above said box-like member, said box-like member comprising a front closed wall, a closed top wall and a rear wall, and being open at its lower end, said rear wall being shorter than said front wall, for intercepting and entrapping the hot convection air heated by contact with said at least one heating element, for providing a cushion of hot air above said at least one heating element, and for permitting escape of said hot air rearwardly, under said shorter rear wall.

2. A device according to claim 1, and a refractory lining in said box-like member, to be heated by said hot convection air for retaining a portion of the heat of said hot convection air.

3. A device according to claim 1, said front wall of said box-like member being directed towards the heated space for radiating heat transmitted to said front wall by said entrapped hot convection air.

4. In a space heating apparatus comprising at least one heating element, reflector means arranged behind said at least one heating element so as to radiate heat towards the space to be heated, both directly from said at least one heating element and from said reflector means, and deflector means arranged behind said reflector means with respect to said space to be heated, said deflector means defining with said reflector means a chimney-like passage open at its lower and upper ends for the convection air to be heated by contact with said reflector means and directed by convection towards the space to be heated; the improvement comprising a box-like member providing an inner volume, a casing enclosing at least said one heating element and extending above said box-like member, said box-like member being arranged above said at least one heating element for intercepting and braking in said inner volume the hot convection air moving upwardly in contact with said at least one heatng element, said box-like member comprising a closed front wall, a closed upper wall and a rear wall, while remaining open at its lower end for intercepting and entrapping said hot upwardly moving convection air leaving said at least one heating element, said rear wall being shorter than said front wall to provide an escape passage for said entrapped air, said escape passage communicating with said chimney-like passage.

5. A device according to claim 4, and a hood member extending forwardly from said front wall for intercepting the upwardly moving convection air leaving said at least one heating element and directing said air towards said box-like member, and means defining a passage between said lower edge of said rear wall and said reflector means, said passage communicating with said chimney-like passage for escape of said entrapped, convection air from said box-like member through said chimney-like passage together with said convection air heated by contact with the rear surface of said reflector means.

6. In a space heating apparatus comprising at least one heating element, reflector means arranged behind said at least one heating element, so as to radiate heat towards the space to be heated, both directly from said at least one heating element and indirectly from said reflector means, and means for directing towards said space to be heated, hot convection air which has been heated by said at least one heating element; the improvement comprising a box-like member, a casing enclosing at least said one heating element and extending above said box-like member, said box-like member being arranged above said at least one heating element, said box-like member comprising a front closed wall, a closed top and a rear wall, and being open at its lower end for entrapping the hot convection air heated by contact with said at least one heating element, for providing a cushion of hot air above said at least one heating element.

* * * * *